US005470291A

United States Patent [19]

Pekkanen

[11] Patent Number: 5,470,291

[45] Date of Patent: Nov. 28, 1995

[54] DEVICE IN A TRAINING APPARATUS

[76] Inventor: Olli Pekkanen, Palomäenrinne 2-4, SF-02730 Espoo, Finland

[21] Appl. No.: 332,439

[22] Filed: Oct. 31, 1994

Related U.S. Application Data

[63] Continuation of Ser. No. 257,576, Jun. 6, 1994, abandoned, which is a continuation of Ser. No. 867,682, Jul. 7, 1992, abandoned.

[30] Foreign Application Priority Data

Jan. 16, 1991 [FI] Finland ..... 900240

[51] Int. Cl.[6] ..... A63B 23/16

[52] U.S. Cl. ..... 482/49; 482/142; 482/96; 482/94

[58] Field of Search ..... 482/48, 49, 98, 482/99, 116, 120, 121, 133; 242/107.3, 107.6, 107.4, 107.4 B, 107.4 R

[56] References Cited

U.S. PATENT DOCUMENTS

| | | | |
|---|---|---|---|
| 2,647,703 | 8/1953 | Hayes | 242/107.4 R |
| 3,315,642 | 4/1967 | Rogers et al. | 242/107.4 R |
| 4,334,677 | 6/1982 | Tata | 482/74 |

*Primary Examiner*—Stephen R. Crow
*Assistant Examiner*—Jerome Donnelly
*Attorney, Agent, or Firm*—Jacobson, Price, Holman & Stern

[57] ABSTRACT

A device in an exercising apparatus, comprising a belt or rope (5) in the grip section (7) which the operator grasps. The position is freely adjustable and can be locked in for the duration of the exercise. The mechanism to actuate locking can either be located in the grip section (7) or be installed at the opposite end of the belt (9). The device is suitable for application in any type of exercising apparatus and is easily adaptable to existing apparatuses. (FIG. 1)

5 Claims, 3 Drawing Sheets

DEVICE IN A TRAINING APPARATUS

This is a continuation of application Ser. No. 08/257,576, filed Jun. 9, 1994 which was abandoned upon the filing hereof; which in turn is a continuation of application Ser. No. 07/867,682, filed Jul. 7, 1992, now abandoned.

BACKGROUND OF THE INVENTION

This invention relates to a device for attachment to an exercising apparatus, either a conventional exercising apparatus or, as will be subsequently explained, a novel kind of apparatus.

Exercising apparatuses are characterized by attachments which the operator holds with the hands or sometimes with the feet when beginning the exercise. There are different kinds of ropes or belts provided with suitable elements, such as handles, for an easier grip and these are usually made of synthetic material.

Accordingly, in cases involving the pulling of ropes or belts, the operating principle is generally such that the rope or belt in the apparatus is fastened to a powerful spring which is drawn by pulling the rope. The further the rope is pulled, the greater is the force to be overcome. It is obvious that in a conventional design, the pull must always start from the same point. This considerably limits the quality and number of movements that can be performed. The same is true of any situation in which various weights are lifted by ropes, belts or the like.

In some previously-known exercising apparatuses, the member for gripping is a bar which is turned about a given joint to work the muscle. In such cases, the outset position of the movement is even more limited and the bar usually allows only a rotational movement from a single outset position to overcome a spring load or the like.

As mentioned above, a drawback to the conventional rope or belt-type devices is the fact that the range of adjustment to allow for different movements is quite restricted.

SUMMARY OF THE INVENTION

The object of this invention is to present an improvement to pulling devices of prior art in rope and belt-type exercising apparatuses. In particular, the invention is meant to contribute to the possibilities for variation of exercise movement in allowing for the utmost simplicity and convenience of movement. Thus, the idea is to enable pulling, pushing and other kinds of movements to be carried out without changing either the position or the location of the body.

The benefits involved in the invention have been achieved by a device, the inventive characteristics of which are rendered in the enclosed claims.

BRIEF DESCRIPTION OF THE DRAWINGS

The invention is now described more specifically in reference to the enclosed drawings, in which.

DESCRIPTION OF THE PREFERRED EMBODIMENT

Figure 1:
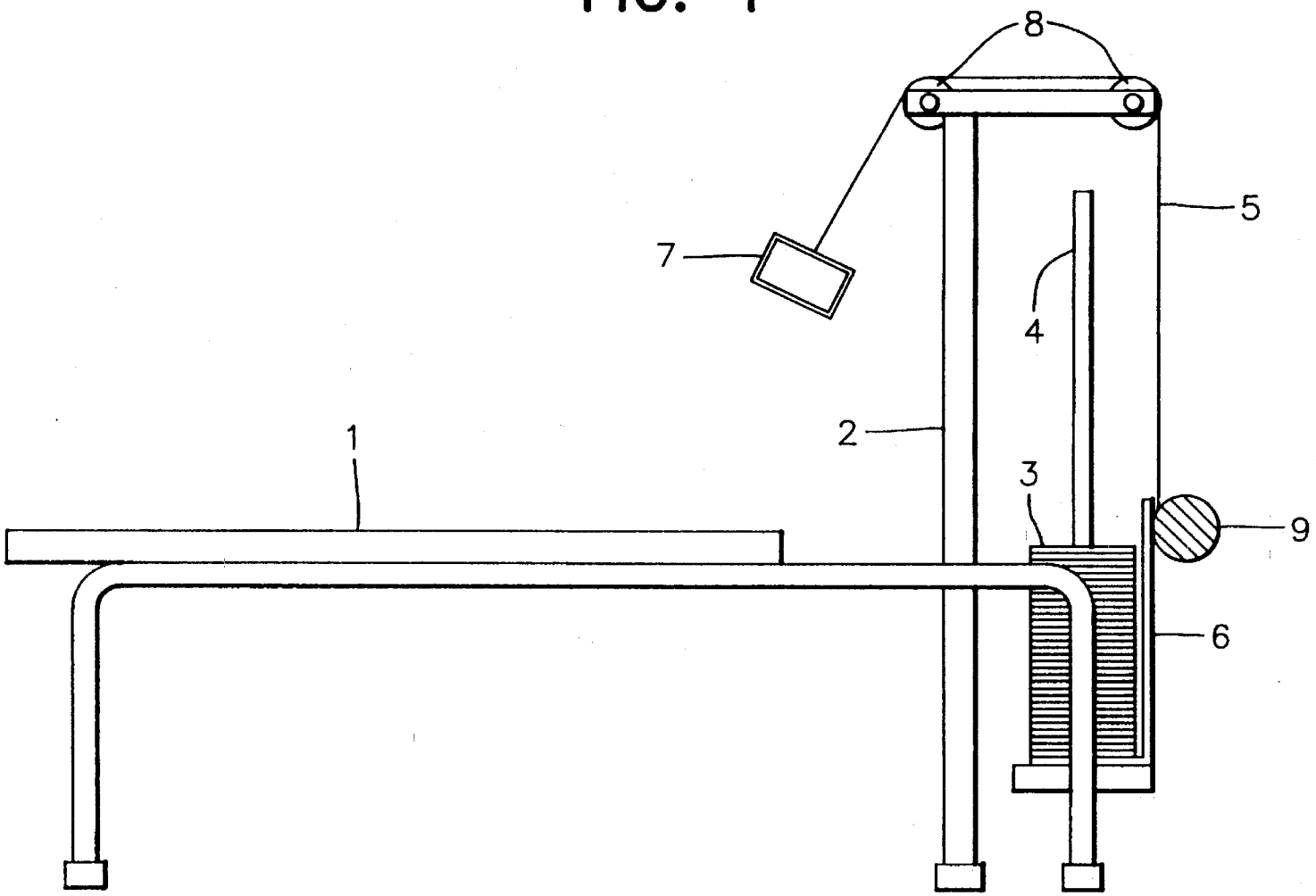
FIG. 1 illustrates a device of this invention as applied to a certain exercising apparatus.

FIG. 1 shows an exercising apparatus consisting mainly of a bench 1 on which the operator lies or sits while performing the exercise. The bench is connected to a frame 2, which is equipped with weights 3 which can be moved upwards on support 4 by operating, a filiform element in the form of a pulling rope or belt 5. The structure of this apparatus further comprises a separate member 6, for fastening a suitable number of weights on the pulling belt. The mode of fastening is described in no further detail here.

Conventionally, such apparatuses have the pulling rope fixed directly on member 6, with the consequence that the handle 7 on pulling rope 5, which runs over two pulleys 8, at all times hangs at the same level above the operator. This has a serious restrictive effect on the quality and number of the movements to be performed.

The operator, in accordance with prior art, can thus grasp the handles 7 and start pulling on them, whereupon the weights 3 start shifting upwards. If the operator wants to make another type of movement, he or she must start the pull from the same outset position as the preceding movement, from a position which may, in fact, be quite disadvantageous. The operator is therefore compelled to take another body position or carry out the movement in a very unfavorable position.

It is an object of this invention to provide a solution to the above problem in the way in which the pulling rope or belt is connected and fixed on member 6 via device 9. Device 9, in turn, is a spool equipped with a relatively slack spring, with no actual effect on the exercise itself, for winding up the rope or belt inside itself as soon as the grip on handle 7 is loosened or the belt is given some slack. Connected to the spool are members which lock immediately and discontinue unwinding the belt when a sharp pull is exerted on the belt. However, a slow pull on the rope or belt allows the belt to unwind from the spool unobstructed.

The unique quality of the idea of the present invention for the purposes of body conditioning or body building is apparent from the above description. It is an object of the invention that a change in the starting point of the movement (i.e. the handle positions) can be accomplished with great ease and speed, and that this permits the working of both arm and leg muscles from exactly the same body position whenever required. The operator thus has no need to change position each time he or she wishes to perform another movement. The handle or handles are grasped and pulled with a level movement into a suitable outset position for the movement chosen. A sharp pull is exerted on the handles whereupon the ropes or belts lock and the movements can start.

Figure 2:
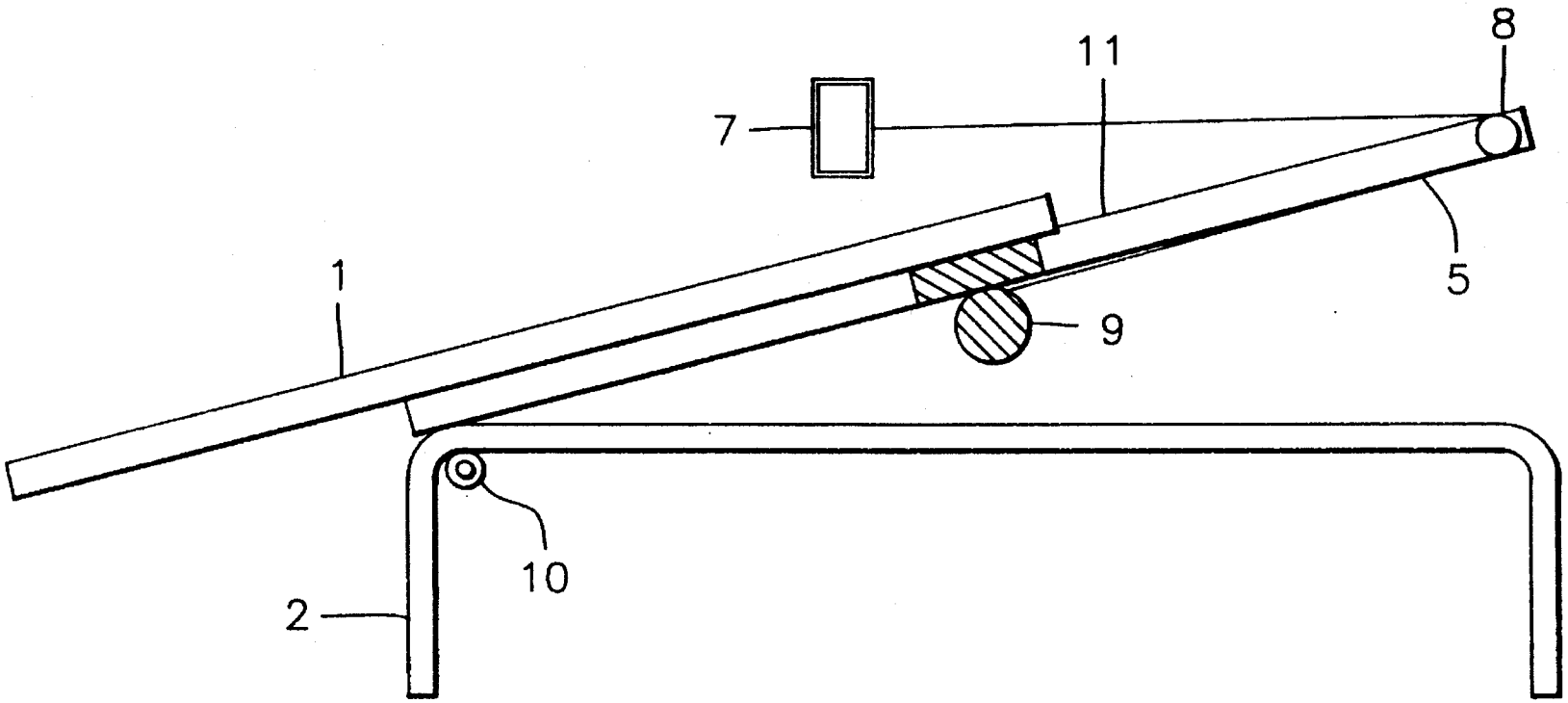
FIG. 2 shows its application to another exercising apparatus filed on the same date as the present application.

A device based on the present invention is particularly beneficial in embodiments for use in connection with a certain exercising apparatus that functions in accordance with a previously unknown operating principle. This embodiment is illustrated in FIG. 2. The device comprises a bench mounted on frame 2 in a sliding mode and with an adjustable angle of inclination. Fastened under the bench is the member 9 of the pulling belt 5 onto which the belt is wound. The belt is then led over a bearing rod or roller 8 to allow the operator, lying on the bench 1, to grasp it at handle 7 or the like. The operator can adjust the length of the pulling belts by the outset position from which he or she wishes to start the movement which calls for physical strain.

As seen in FIG. 2, the operator actually pulls himself and the bench 1 up the inclined plane. This is because the bench 1 is supported in a sliding mode, so as to rest on the bearer or rod 11 connected by an articulated joint 10 to frame 2. Rod 11 is adjustable in its angle of inclination by means which are not illustrated in this figure for reasons of clarity.

The exercise takes place in exactly the same way as in the previous case. The operator draws the desired length of belts from roll 9, pulls to lock them into position and starts exercising. The only exceptional feature here is that the operator pulls himself up an inclined plane, and hence does not exercise by drawing a spring or lifting a separate weight.

For another form of exercise, the spool can be fitted inside the handles which the operator grasps when starting the exercise. The mechanism provided for locking the rope or belt in position is small and light and presents no restrictions to use. From this embodiment is derived an application in which the locking of the rope or belt into position is effected following a manual operation, not a pull, as above. In some cases it may, in fact, be useful for the operator to be able to adjust his or her grip accurately and in the way he or she wishes.

Figure 3:
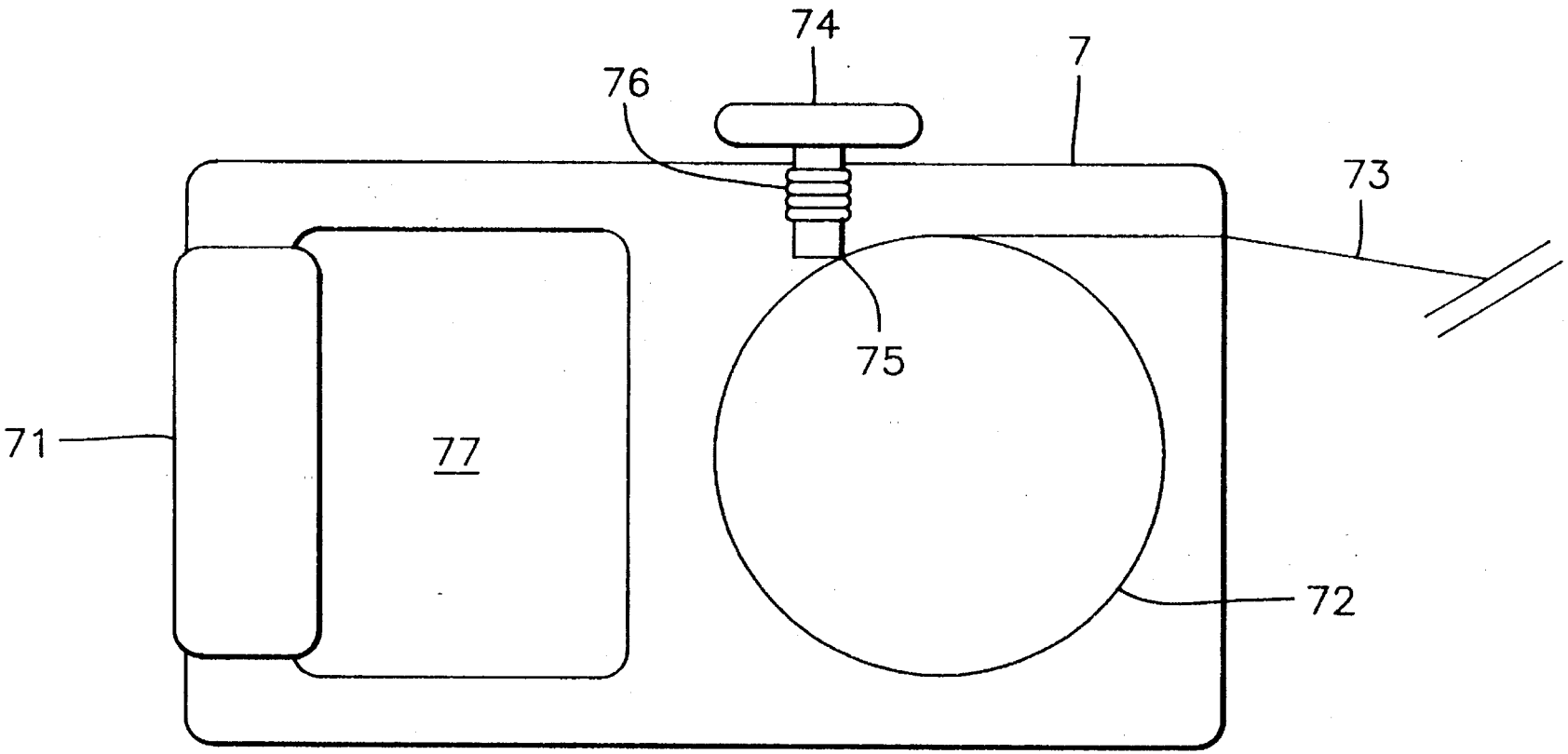
FIG. 3 shows a further embodiment of the invention.

The aforementioned application, illustrated in FIG. 3, comprises a handle with a grip section 71 which the operator grasps at the beginning of the exercise. The handle contains a spool 72 onto which rope 73 is wound driven by a spring not illustrated here. Locking can be accomplished by means of button 74. When the button is suitably suppressed with the thumb, the spindle 75 will squeeze against the edge of spool 72, whereupon the belt locks in position. When the pressure on the button is lightened, spring 76 causes the button to lift up, thereby releasing the rope. For pressing the button, the thumb, which is known to have little else to do during exercises, is very convenient.

The button or any other devise that can be used for locking, can also be suitably located on the grip section 71 of handle 7 on the side next to aperture 77 so that the operator, when squeezing his or her hand around handle 71 automatically suppresses the proper stop catch to lock the belt or rope in place. A loose grip allows the belt to run from and onto the spool.

In a further embodiment of the present invention, the belt or rope runs freely through the handle, whereupon locking takes place in any of the modes described above, the remaining section of the belt or rope being left hanging loose. Similarly, this principle can be adopted when the locking device is located near the far end of the belt or rope as seen from the operator, e.g. attached to the weights or spring. In this case, if the locking device does not have a winding mode, the exercising apparatus is provided with a suitable lever or spring, mounted on its frame for example, which carries the rope away from the operator so that the grip can be adjusted as desired. It is obvious that in this case, it is preferable that the locking of the belt in position should be carried out in such a manner that the operator needs not do the locking by hand. Hence, the pull principle described above, or any other automatic principle, is convenient for the purpose.

Examples of automatically pull-activated locking devices are those used in the starters of small engines, where a sharp pull on the starter rope will cause "claws" or the like to be raised by friction and the claws in turn catch, for example, the machine's crankshaft to make it rotate. In an embodiment of the present invention, the claws or the like respectively catch the fixed member and lock the spool or the like into position.

The locking system familiar from self-winding safety belts is also suitable for the purpose. Whereas the self-winding safety belt includes an attachment to allow different locking positions according to the safety belt position, such a function is in this case unnecessary and even harmful, and must therefore be eliminated. This is particularly true for situations in which the mechanism has been attached to a member that has an adjustable position.

The device of the present invention is adaptable to any known exercising apparatus so as to enhance its properties and to make it a more versatile and a better medium for exercise. This is needed in a number of cases as there are a multitude of apparatuses on the market which can benefit substantially from a device in accordance with the present invention.

I claim:

1. An exercising apparatus adapted to be used in combination with a means for supporting said apparatus comprising:

a frame;

a support means which is positioned on and adapted to move linearly along said frame while carrying a resistive load;

a pulling device through which an operator works to move said supporting means for bodybuilding purposes, said pulling device including a filiform element having a gripping member at one end of the filiform element, a spool connected to said support means and onto which the filiform element is wound from its opposite end, said spool being driven by spring means to wind on the filiform element and which spool includes means for allowing the filiform element to be drawn out to a predetermined position and locked in said position thereby allowing variation of the exposed length of the filiform element which is withdrawn from the spool prior to commencing an exercise.

2. Apparatus according to claim 1 further including means fitted into said gripping member for allowing the filiform element to be drawn out of the spool to a predetermined position.

3. Apparatus according to claim 1 further including a manually operated button which, when pressed against the spool, locks the filiform element in the predetermined position.

4. Apparatus according to claim 1 wherein said means for supporting said apparatus includes an exercise bench, wherein said frame is located at one end of said exercise bench and said support means is mounted for vertical movement on the frame.

5. Apparatus according to claim 1 wherein said support means comprises an exercise bench mounted on said frame for sliding movement.

* * * * *